US005890491A

United States Patent [19]

Rimkus

[11] Patent Number: 5,890,491

[45] **Date of Patent: *Apr. 6, 1999**

[54] NOSE FILTER

[75] Inventor: Ron Rimkus, Flossmoor, Ill.

[73] Assignee: AMTEC Products, Inc., Flossmoor, Ill.

[ * ] Notice: The term of this patent shall not extend beyond the expiration date of Pat. No. 5,568,808.

[21] Appl. No.: 922,405

[22] Filed: Sep. 3, 1997

[51] Int. Cl.[6] ..... A62B 23/06

[52] U.S. Cl. ..... 128/206.11; 128/204.12; 128/204.13

[58] Field of Search ..... 128/206.11, 204.12, 128/204.13, 205.27

[56] References Cited

U.S. PATENT DOCUMENTS

| | | | |
|---|---|---|---|
| 1,071,015 | 8/1913 | Adler . | |
| 1,823,094 | 9/1931 | Dylong . | |
| 3,145,711 | 8/1964 | Beber . | |
| 3,457,917 | 7/1969 | Mercurio | 128/206.11 |
| 3,463,149 | 8/1969 | Albu . | |
| 3,774,601 | 11/1973 | Langone . | |
| 3,905,335 | 9/1975 | Kapp . | |
| 4,052,983 | 10/1977 | Bovender . | |
| 4,984,302 | 1/1991 | Lincoln . | |
| 5,392,773 | 2/1995 | Bertrand | 128/206.11 |
| 5,417,205 | 5/1995 | Wang . | |
| 5,568,808 | 10/1996 | Rimkus | 128/206.11 |

*Primary Examiner*—John G. Weiss
*Assistant Examiner*—Charles W. Anderson
*Attorney, Agent, or Firm*—Wallenstein & Wagner, Ltd.

[57] ABSTRACT

A disposable nose filter to be inserted in a nostril, including a flexible housing, a filtering component, a flange and an adhesive component. The nose filter is adapted to be easily inserted and removed from the nostril. When positioned in the nasal passage of a nostril the nose filter becomes fixedly attached inside the nostril through the adhesive component, until removal. The flange forms a seal with the lower exterior portion of the nostril, thus, forcing air through the filter and preventing air from passing between the housing and the inner walls of the nostril.

25 Claims, 2 Drawing Sheets

NOSE FILTER

TECHNICAL FIELD

The present invention relates to disposable nose filters which, when positioned in a nasal passage of a nostril becomes fixedly attached inside the nostril until removal due to an adhesive component on the outer surface of the nose filter. The nose filter purifies and warms the air, and also moistens and medicates the mucous membranes of the sinus cavity.

BACKGROUND OF THE INVENTION

Prior attempts to provide a disposable respiratory nose filter generally fall within one of two categories: mask-style nose filters, i.e., those which are designed to cover the exterior of the nostrils of the nose; and, intrusive-style nose filters, i.e., those which are designed to be inserted into a nasal passageway of the nose.

U.S. Pat. No. 5,392,773 and the patents listed therein generally disclose mask-like nose filters. Specifically, U.S. Pat. No. 5,392,773 discloses a mask-like filter which includes a meshed filter region surrounded by an adhesive region. The adhesive region further includes tabs which adhere to the base, lateral and tip portions of the nose.

U.S. Pat. Nos. 3,774,601 and 4,984,302 disclose the use of cotton, wool, polyethylene or polyester as a material used to filter particulate in a nose filter attached to the exterior of the nose. Both filters, however, cover a large portion of the facial area and can irritate the skin it comes is contact with. Generally speaking, mask-like nose filters are extremely awkward, cumbersome and unsightly. Further, when mask-like nose filters become wet, they cling or stick to the face of the wearer making it difficult to speak or breathe. Additionally, such nose filters lack aesthetic appeal.

Intrusive-style nose filters are disclosed in U.S. Pat. Nos. 3,457,917, 3,905,335, 4,052,983, 5,417,205 and 5,568,808. U.S. Pat. No. 3,457,917 discloses a non-disposable nose filter which includes a filter retaining means (i.e., a housing), filtering material, and a detachable cap having a finger gripping means provided at the end of the cap. Unlike the present invention, the filter retaining means in U.S. Pat. No. 3,457,917 is formed from a hard molded plastic such as polytetrafluorethylene or Bakelite.

U.S. Pat. No. 3,905,335 discloses a nasal air filter comprising a pair of interconnected cylinders having a filter material contained within. The cylinders further contain yieldable flange means which engage the inner nostril walls.

U.S. Pat. No. 4,052,983 discloses a filter device insertable into the nasal passages which include a pair of flexible casings, each casing releasable receives a filter cartridge. The filter cartridges have a multitude of cilia-like, nylon filaments which act to electrostatically charge the air as it moves past the filaments, thus aiding in the filtering process.

U.S. Pat. No. 5,417,205 discloses an air filter comprised of two filter units linked by a connecting element. Each filter unit further comprises first and second gauze filters and a plurality of rods which extend from the first gauze filter to the second gauze filter and retain a stack of wet filter cloth between the gauze filters.

U.S. Pat. No. 5,568,808 discloses an air filter generally comprised of a housing, a filter component and a flutter valve. Upon inhalation the flutter valve forms a seal with the lower external portion of the nostril forcing air to pass through the filter component. Upon exhalation the seal between the flutter valve and the external portion of the nostril is broken allowing air to escape through the area between the housing and the inner wall of the nostril. If such an air filter is used with an over abundance of medicant or aqueous solutions, the broken seal would allow the medicant or solutions to escape from the nostril.

An improved nose filter in accordance with the present invention eliminates the drawbacks and unpleasantries of the prior nose filters described above.

SUMMARY OF THE INVENTION

The nose filter of the present invention is adapted to be inserted into a nostril and includes a flexible housing, a filtering component, a flange and an adhesive component. The housing includes an open bottom end, a top end and a side wall having a top portion and a bottom portion. A cavity is disposed within the housing and being inside the side wall and between the top end and the bottom end of the housing. The filtering component is disposed in the cavity of the housing. The flange has a diameter larger than the diameter of the inner wall of the nostril and extends radially outwardly from the side wall of the housing. The adhesive component is applied to an outer surface of the flexible housing or, alternatively, to a first surface of the flange, or to both the housing and the flange. Upon insertion of the nose filter into the nostril, the first surface of the flange engages and forms a seal with either an external lower portion of the nostril or a portion of the inner wall of the nostril. Additionally, upon insertion, the adhesive component of the nose filter adhesively attaches, until removal, the nose filter within the nasal passage of the nostril.

According to a first aspect of the present invention there is provided a disposable nose filter which filters dust, germs, allergic matter, or other foreign particulate from the air passing through the nostrils into the sinus cavity. It has been found that as the air passes through the nose filter, the air is also warmed before it reaches the sinus cavity and eventually the lungs.

In another aspect of the present invention there is provided a disposable nose filter which forms a seal with the nostril, thus, forcing air through the filter and preventing air from passing between the nose filter and the inner walls of the nostril. Additionally, the nose filter is adhesively attached to either the inner wall of the nostril, the external lower portion of the nostril, or both, thereby fixing the nose filter in place such that the nose filter and the flange do not move during inhalation or exhalation. As such, only a small portion of the nose filter is exposed from the nostril. Accordingly, the nose filters of the present invention are more aesthetically pleasing and comfortable when worn, and are not cumbersome, awkward or unsightly like prior nose filters.

In another aspect of the present invention, there is provided a pre-filtering component proximate the bottom portion of the filtering component. The pre-filtering component filters out any large particles from entering the cavity and ultimately the filtering component of the nose filter. This allows the filtering component to be more efficient in purifying and warming the inhaled air and also increases the life of the filtering component.

In yet another aspect of the present invention, there is provided a nose filter which moisturizes the mucous membranes of the sinus cavity and prevents dryness or irritation due to pollen, smoke, industrial chemicals, perfumes, dust, mold, and other allergenic.

In a final aspect of the present invention, there is provided a nose filter which can be easily inserted and removed from the nostril, and which will conform to the shape of the nasal passageway.

Other advantages and aspects of the present invention will become apparent upon reading the following description of the drawings and detailed description of the invention.

DETAILED DESCRIPTION OF THE INVENTION

Figure 1:
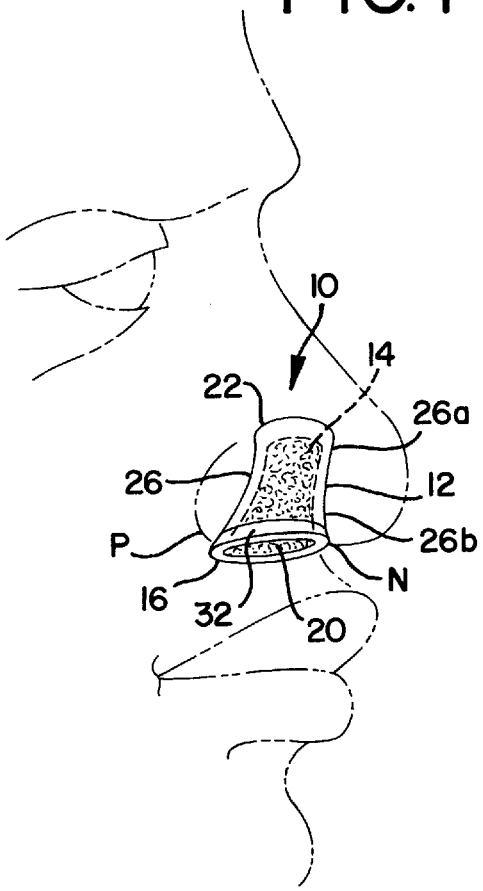
FIG. 1 is a view of a nose filter according to the present invention inserted into a nostril and wherein the flange forms a seal with the external lower portion of the nostril.

While this invention is susceptible of embodiment in many different forms, there is shown in the drawings and will herein be described in detail a preferred embodiment of the invention. It is to be understood that the present disclosure is to be considered as an exemplification of the principles of the invention. This disclosure is not intended to limit the broad aspect of the invention to the illustrated embodiment or embodiments.

Figure 2:
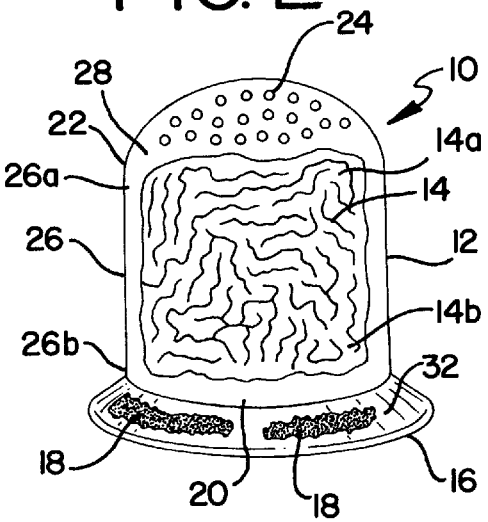
FIG. 2 is a front sectional view of the nose filter illustrated in FIG. 1 according to a first embodiment of the present invention.

Referring now in detail to the drawings and initially to FIGS. 1 and 2, there is shown a preferred embodiment of nose filter 10 constructed in accordance with the present invention. FIG. 1 illustrates the nose filter 10 inserted into nostril N. In general, the nostril N includes an inner wall having a diameter and an external lower portion P. The nose filter 10 preferably comprises a flexible housing 12, a filtering component 14, a flange 16 and an adhesive component 18. The flexible housing 12 has an open bottom end 20, a top end 22 having at least one air passageway 24, a side wall 26 having a top portion 26*a* and a bottom portion 26*b*, and a cavity 28 located within the housing 12 and being inside the side wall 26 and between the top end 22 and the bottom end 20 of the housing 12.

Figure 3:
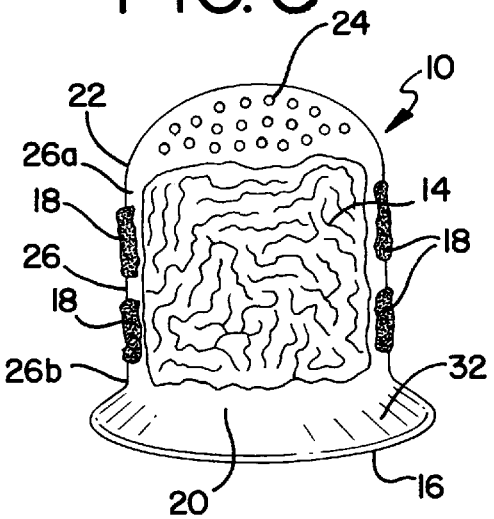
FIG. 3 is a front sectional view of the nose filter illustrated in FIG. 1 according to a second of the present invention.
Figure 7:
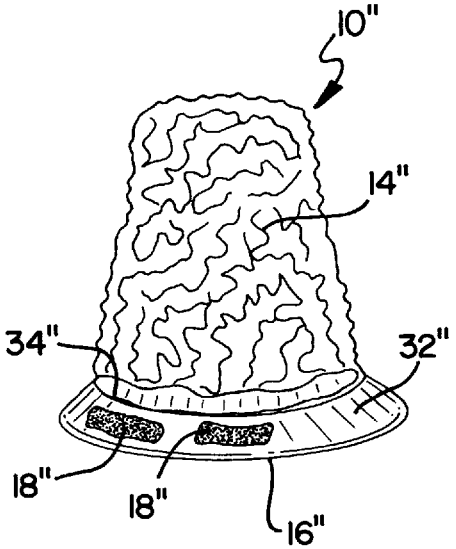

In the embodiment illustrated in FIG. 2, the top end 22 of the flexible housing 12 has a plurality of air passageways 24. Also, the filtering component 14 has a top portion 14*a* and a bottom portion 14*b* and is disposed within the housing cavity 28. As shown in FIG. 2, the flange 16 has a diameter larger than the diameter of the inner wall of the nostril N, and can be connected to the nose filter 10 at either the bottom portion 26*b* of the side wall 26, or to the bottom portion 14*b* of the filtering component 14, as shown in FIG. 7. In either embodiment, the flange 16 extends radially outwardly from the bottom portion 26*b* of the side wall 26 so that when the nose filter 10 is inserted into the nostril N, the flange 16 is partially exposed from the nostril N and engages the external lower portion P of the nostril N (See FIG. 1). However, the flange 16 may also engage the internal wall of the nostril N if the nose filter 10 is inserted high enough in the nasal passage of the nostril N (See FIG. 1A). As shown in FIG. 2 the flange 16 may be separate from, but connected to the bottom portion 26*b* of the side wall 26 of the flexible housing 12. Alternatively, as shown in FIG. 3, the flange 16 may be molded integral with the bottom portion 26*b* of the side wall 26. In another embodiment, shown in FIG. 7, the flange 16 may be connected to or molded integral with the filtering component 14.

The flange 16 further has a first surface 32. With reference to FIG. 1, following insertion of the nose filter 10 into the nostril N, the first surface 32 of the flange 16 remains adjacent the external lower portion P of the nostril N as shown in FIG. 1. The flange 16 thickness is generally the same thickness as the housing 12. However, the flange 16 may also be considerably thinner than the flexible housing 12, including less than half the thickness of the side wall 26 of the housing 12. This allows the first surface 32 of the flange 16 to engage, and form a tight seal against, the external lower portion of nostril N.

Figure 1A:
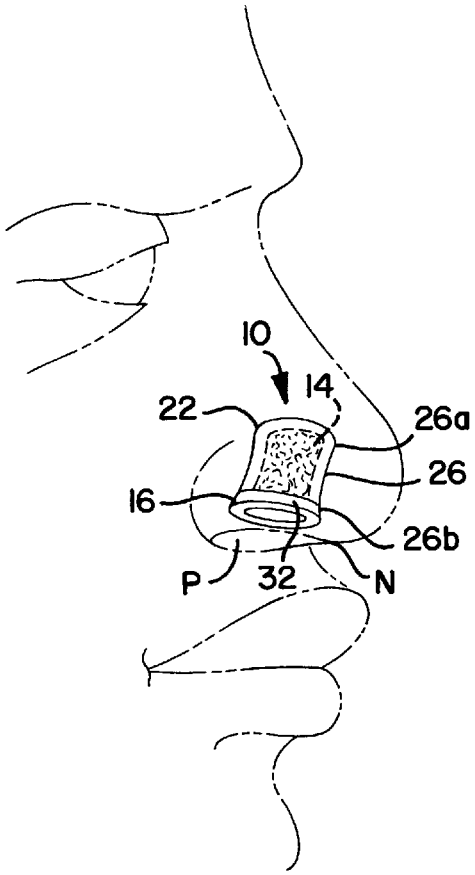
FIG. 1A is a view of a nose filter according to the present invention inserted higher into a nostril and wherein the flange forms a seal with the inner wall of the nostril.

With reference to FIG. 1A, in an alternate use, the nose filter 10 is inserted higher into the cavity of the nostril N. In this use the first surface 32 of the flange 16 forms a seal with the inner wall of the nostril N.

As shown in FIGS. 2 and 3, an adhesive component 18 is applied to the nose filter 10. The adhesive component 18 fixedly secures the nose filter 10 to the nostril so that neither the nose filter 10 nor the flange 16 moves during either inhalation or exhalation. The adhesive component 18 can be applied to the nose filter 10 in a variety of locations. In FIG. 2 the adhesive component 18 comprises an adhesive disposed about at least a portion of the first surface 32 of the flange 16. As such, the adhesive component 18 can take the form of a plurality of adhesive elements including: an adhesive strip, a single adhesive element or multiple adhesive elements. In a preferred embodiment, the adhesive component 18 is applied to the nose filter 10 on the first surface 32 of the flange 16. By utilizing the first surface 32 of the flange 16 as a location for the adhesive component 18, it allows the flange 16 to be fixedly secured to either the lower external portion P of the nostril N or the inner wall of the nostril N during installation of the nose filter 10 as illustrated in FIGS. 1 and 1A, respectively. Thus, the flange 16 remains adhesively fixed to the nostril N, forming a seal with either the external lower portion P of the nostril N or the inner wall of the nostril N. As such, all outside air which enters the user's body through the nostril N will be filtered. Also, neither the flange 16 nor any other element of the nose filter 10 moves during breathing when fixed in this manner.

As shown in FIG. 3, the adhesive component 18 can be an adhesive disposed about at least a portion of a circumference of the flexible housing 12. As with the adhesive component 18 on the flange 16 in FIG. 2, the adhesive component 18 on the circumference of the flexible housing 12 can consist of a variety of forms. In a preferred alternate location illustrated in FIG. 3, the adhesive component 18 is formed of a continuous strip around the entire circumference of the side wall 26 of the housing 12, preferably near the bottom portion 26*b*. However, additional locations can be utilized. Also, it is possible to utilize multiple adhesive locations on the same nose filter 10. As such, the adhesive component 18 could be comprised of an adhesive disposed about at least a portion of both the first surface 32 of the flange 16 and a circumference of the flexible housing 12.

Therefore, as the person wearing the nose filter 10 breathes, the flange 16 and the entire nose filter 10 remains stationary. As best illustrated in FIG. 1, upon insertion, the flange 16 forms a seal with the nostril N. This seal forces air through the filtering component 14 and also prevents air from passing between the side wall 26 of the housing 12 and the inner walls of the nostril N. Thus, all the air entering the sinus cavity will be filtered. Upon exhalation, the adhesive between: the inner wall of the nostril N and the side wall 26 of the nose filter 12, the external lower portion P of the nostril N or the inner wall of the nostril N and the first surface 32 of the flange 16 or both areas, forces all exhaled air through the nose filter 10 or out the mouth. Thus, air never passes between the side wall 26 of the housing 12 and the inner wall of the nostril N. As a result, the nose filter 10 of the present invention remains more comfortable for the user and less visible to others.

The nose filter 10 of the present invention has additional uses. Since the nose filter 10 forms a seal with either the inner wall or lower external portion P of the nostril N, the nose filter 10 is useful in preventing body fluids from exiting the nostril N. Specifically, the nose filter 10 of the present invention can be used to stop nosebleeds; with the seal between flange 16 and the nostril N preventing the fluid from exiting the nose and the filter component 14 absorbing the fluid.

The adhesive component used with the nose filter 10 can be made of any type of adhesive, however, a medical grade adhesive is preferred such that the adhesive does not irritate the skin of the user. In a preferred embodiment, the adhesive component 18 is a medical grade adhesive manufactured by 3M Company under the trade name 3M No. 1776.

Figure 4:
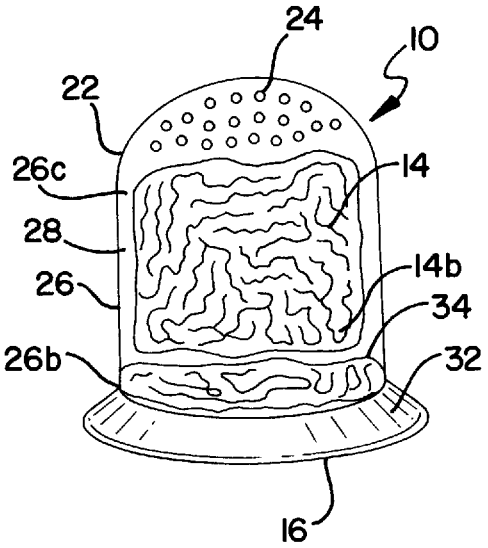
FIG. 4 is a front sectional view of the nose filter illustrated in FIG. 1 according to a third embodiment of the present invention.

Referring now to FIG. 4, a pre-filtering component 34 proximate the bottom portion 14*b* of the filtering component 14 may be employed with the nose filter 10. The pre-filtering component 34 provides for an initial screening of incoming air passing through the nose filter 10. In a preferred embodiment, the pre-filtering component 34 is manufactured by 3M Company under the trade name Filtrete. The pre-filtering component 34 at least filters out any larger particles in the air from entering the cavity 28 of the housing 12. This allows the filtering component 14 to be utilized mainly for warming or moisturizing the inhaled air. However, the pre-filtering component 34 further decreases the amount of impurities entering the filtering component 14, yielding a more efficient filtering component 14 and also increasing the life of the filtering component 14.

Figure 5:
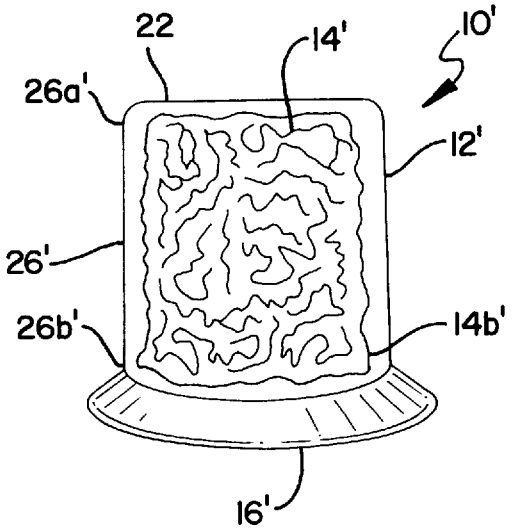
FIG. 5 is a front sectional view of the nose filter illustrated in FIG. 1 according to a fourth embodiment of the present invention.
Figure 6:
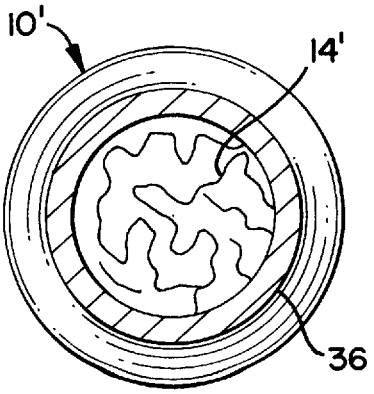
FIG. 6 is a top plan view of the nose filter illustrated in FIG. 5; and, FIG. 7 is a longitudinal sectional view of the nose filter illustrated in FIG. 1 according to a final embodiment of the present invention.

Referring now to FIGS. 5 and 6, in another embodiment of nose filter 10' of the present invention, the top end 22' of flexible housing 12' consists of a large air passageway 24' and retaining ridge 36. Retaining ridge 36 prevents filtering component 14' from being dislodged from the flexible housing 12' during the breathing process. Like the nose filters 10 illustrated in FIGS. 2 and 3, the flange 16' of nose filter 10' illustrated in FIGS. 5 and 6 can be: (1) connected at one end to either the bottom portion 26*b*' of the side wall 26' or to the bottom portion 14*b*' of the filtering component 14', or (2) integral with either the bottom portion 26*b*' of the side wall 26' or the bottom portion 14*b*' of the filtering component 14'. Similarly, like nose filter 10, an adhesive component 18' is utilized either on the flange 16', on the side wall 26' of the housing 12', or on both elements to fixedly secure the nose filter 10' inside the nostril N so that the nose filter 10' and the flange 16' do not move during breathing. Also, like nose filter 10, in this embodiment a pre-filtering component 34' may be employed in the nose filter 10'.

With reference to FIG. 7, in another embodiment of the present invention, nose filter 10" consists solely of a filtering component 14" and a flange 16". Flange 16" can be connected to the bottom portion 14*b*" of filtering component 14" by a heat treatment which essentially fuses the materials of the filtering component 14" and the flange 16" together, or it can be connected by any conventional, non-toxic adhesive. In this embodiment the adhesive component 18" is comprised of an adhesive disposed about at least a portion of either or both of the first surface 32" of the flange 16" and/or a circumference of the filtering component 14". Also, as with the embodiment illustrated in FIG. 4, this nose filter 10" may include a pre-filtering component 34" proximate the bottom portion of the filtering component 14".

In all of the embodiments of the present invention, any suitable material such as cotton or a cellulose material may be used to form the filtering component 14, 14' and 14". However, in a preferred embodiment, filtering component 14, 14' and 14" consists of an absorbent material. Specifically, the filtering component 14, 14' and 14" consists of a reticulated polyurethane. Depending on the density and filtering required for the application by the filtering component 14, 14' and 14", the reticulated polyurethane may include either 60 pores per inch ("PPI"), 80 PPI or 100 PPI. The filtering component 14, 14' and 14" may further be soaked in a saline solution, herbal or vitamin oil, medicant or any aqueous solution. For example, the nose filters of the present invention may be moistened with a nose drop spray, medicant or aqueous solution even when the filter is inserted in the nostril.

In the embodiments of the present invention illustrated in FIGS. 1–6, any suitable plastic or rubber-like material, including a synthetic rubber latex or silicone, which is non-toxic and which will not irritate the inner wall of the nostril N may be used to form flexible housing 12, 12'. In a preferred embodiment flexible housing 12, 12' is formed from a silicone rubber material. However, the present invention also contemplates embodiments where flexible housing 12, 12' comprises a natural porous material such as cotton, linen, gauze or the like. It has been found that when flexible housing 12, 12' is formed from a plastic or rubber-like material and the nose filter 10, 10' is inserted into the nostril, flexible housing 12, 12' also aids in forcing the nasal passageway open, thus allowing more air to pass through the nose filter 10, 10' and into the sinus cavity.

When the nose filters of the present invention are not in use, they may be kept in a convenient container filled with a saline or other aqueous solution to keep the filtering component moist. It will also be understood that the size and shape of the nose filters of the present invention may be varied to accommodate noses of different sizes and shapes.

While the specific embodiments have been illustrated and described, numerous modifications come to mind without markedly departing from the spirit of the invention. The scope of protection is only intended to be limited by the scope of the accompanying claims.

What I claim is:

1. A nose filter for insertion into a nostril, the nostril including an inner wall having a diameter and an external lower portion, the nose filter comprising:

a flexible housing having an open bottom end, a top end, a side wall having a top portion and a bottom portion, and a cavity located inside the side wall and between the top end and the bottom end of the housing;

a filtering component disposed in the housing cavity, the filtering component having a top portion and a bottom portion;

a flange having a diameter larger than the diameter of the inner wall of the nostril, the flange extending radially outwardly from the bottom end of the flexible housing and having a first surface which forms a seal with the nostril; and, an adhesive component applied to the nose filter.

2. The nose filter of claim 1, wherein the flange is connected to the bottom portion of the filtering component.

3. The nose filter of claim 1, wherein the flange is connected to the bottom portion of the side wall of the flexible housing.

4. The nose filter of claim 1, wherein the adhesive component comprises an adhesive disposed about at least a portion of a circumference of the flexible housing.

5. The nose filter of claim 1, wherein the adhesive component comprises an adhesive disposed about at least a portion of the first surface of the flange.

6. The nose filter of claim 1, wherein the adhesive component comprises an adhesive disposed about at least a portion of both the first surface of the flange and a circumference of the flexible housing.

7. The nose filter of claim 1 wherein the first surface of the flange forms a seal with the external lower portion of the nostril.

8. The nose filter of claim 1, wherein the first surface of the flange forms a seal with the inner wall of the nostril.

9. The nose filter of claim 1, wherein the flexible housing is formed from a silicone rubber material.

10. The nose filter of claim 1, wherein the thickness of the flange is less than half the thickness of the side wall of the flexible housing.

11. The nose filter of claim 1, wherein the thickness of the flange is approximately the same as the thickness of the side wall of the flexible housing.

12. The nose filter of claim 1, wherein the flexible housing comprises a natural porous material selected from the group consisting of cotton, linen, and gauze.

13. The nose filter of claim 1, wherein the filtering component comprises an absorbent material.

14. The nose filter of claim 13, wherein the absorbent material is soaked in an aqueous solution.

15. The nose filter of claim 1, further comprising a pre-filtering component proximate the bottom portion of the filtering component.

16. A nose filter for insertion into a nostril, the nostril including an inner wall having a diameter and an external lower portion, the nose filter comprising:

a filtering component having a top portion and a bottom portion;

a flange having a diameter larger than the diameter of the inner wall of the nostril, the flange extending radially outwardly from the filtering component and having a first surface which forms a seal with the nostril; and, an adhesive component applied to the nose filter.

17. The nose filter of claim 16, wherein the adhesive component comprises an adhesive disposed about at least a portion of a circumference of the filtering component.

18. The nose filter of claim 16, wherein the adhesive component comprises an adhesive disposed about at least a portion of the first surface of the flange.

19. The nose filter of claim 16, wherein the adhesive component comprises an adhesive disposed about at least a portion of both the first surface of the flange and a circumference of the filtering component.

20. The nose filter of claim 16, wherein the first surface of the flange forms a seal with the external lower portion of the nostril.

21. The nose filter of claim 16, wherein the first surface of the flange forms a seal with the inner wall of the nostril.

22. The nose filter of claim 16, wherein the flange is formed from a silicone rubber material.

23. The nose filter of claim 16, wherein the filtering component comprises an absorbent material.

24. The nose filter of claim 16, further comprising a pre-filtering component proximate the bottom portion of the filtering component.

25. A nose filter for insertion into a nostril, the nostril including an inner wall having a diameter and an external lower portion, the nose filter comprising:

a flexible housing having an open bottom end, a top end, a side wall having a top portion and a bottom portion, and a cavity located inside the side wall and between the top end and the bottom end of the housing;

a filtering component disposed in the housing cavity, the filtering component having a top portion and a bottom portion;

a flange having a diameter larger than the diameter of the inner wall of the nostril, the flange extending radially outwardly from the bottom end of the flexible housing and having a first surface which forms a seal with the nostril;

an adhesive component applied to the nose filter; and, a pre-filtering component proximate the bottom portion of the filtering component.

* * * * *